US009181022B2

(12) United States Patent
Armstrong

(10) Patent No.: US 9,181,022 B2
(45) Date of Patent: Nov. 10, 2015

(54) TROPHY CONTAINER APPARATUS

(71) Applicant: Tommy Armstrong, Kosciusko, MS (US)

(72) Inventor: Tommy Armstrong, Kosciusko, MS (US)

( * ) Notice: Subject to any disclaimer, the term of this patent is extended or adjusted under 35 U.S.C. 154(b) by 0 days.

(21) Appl. No.: 14/289,954

(22) Filed: May 29, 2014

(65) Prior Publication Data

US 2014/0353351 A1 Dec. 4, 2014

Related U.S. Application Data

(60) Provisional application No. 61/828,292, filed on May 29, 2013.

(51) Int. Cl.

| | |
|---|---|
| ***B65D 33/06*** | (2006.01) |
| ***B65D 33/00*** | (2006.01) |
| ***B65D 81/38*** | (2006.01) |
| ***B65D 85/00*** | (2006.01) |
| ***A45C 5/00*** | (2006.01) |
| ***A45C 13/10*** | (2006.01) |
| *A45C 5/03* | (2006.01) |
| *A45C 13/02* | (2006.01) |

(52) U.S. Cl.

CPC . *B65D 85/00* (2013.01); *A45C 5/00* (2013.01); *A45C 13/103* (2013.01); *A45C 2005/035* (2013.01); *A45C 2013/026* (2013.01); *A45C 2013/1015* (2013.01)

(58) Field of Classification Search

CPC ..... A45F 3/02; A45F 3/14; A45F 2003/142; A45F 2003/002; B65D 85/00

USPC ..... 383/97, 98, 99, 110, 111, 6, 4, 61.3

See application file for complete search history.

(56) References Cited

U.S. PATENT DOCUMENTS

| | | | | |
|---|---|---|---|---|
| 1,700,615 | A * | 1/1929 | O'Brien | 220/592.24 |
| 1,768,989 | A * | 7/1930 | Laacke | 383/99 |
| 2,141,906 | A * | 12/1938 | Friedlander | 383/99 |
| D251,083 | S * | 2/1979 | Rabinowitz et al. | D3/289 |
| 4,489,815 | A * | 12/1984 | Martinez et al. | 190/1 |
| 4,790,029 | A * | 12/1988 | LaFleur et al. | 383/24 |
| 5,237,838 | A | 8/1993 | Merritt-Munson | |
| 5,474,185 | A * | 12/1995 | Franke | 206/586 |
| 5,761,992 | A | 6/1998 | Gallo | |
| 6,135,333 | A | 10/2000 | Tucker et al. | |
| 6,253,569 | B1 | 7/2001 | Hall | |
| 6,276,698 | B1 | 8/2001 | Calandra | |
| 6,508,077 | B1 | 1/2003 | Vander Boegh et al. | |
| 6,510,705 | B1 | 1/2003 | Jackson | |
| 7,338,210 | B1 | 3/2008 | Fultz et al. | |
| 7,634,919 | B2 | 12/2009 | Bernhard, Jr. et al. | |
| 7,954,503 | B2 | 6/2011 | Glass | |
| 8,485,757 | B2 * | 7/2013 | Nomoto | 405/107 |
| 8,936,172 | B2 * | 1/2015 | Hicks | 220/592.2 |
| 2009/0032562 | A1 * | 2/2009 | Glass | 224/577 |
| 2011/0036849 | A1 | 2/2011 | Sturrock | |
| 2014/0166714 | A1 * | 6/2014 | Peisley et al. | 224/645 |

* cited by examiner

*Primary Examiner* — Jes F Pascua

(74) *Attorney, Agent, or Firm* — Buckingham, Doolittle & Burroughs, LLC

(57) ABSTRACT

A collapsible container for protecting and transporting an animal head is provided. The collapsible container comprises at least one strap for carrying the collapsible container and a base component comprising a bottom, four sides, a lid. The lid comprises four triangular flaps and an opening centrally located in the lid. The four triangular flaps open to allow a hunter to place the animal head within the base component, while the opening permits passage of the animal head's antlers through the lid. The four triangular flaps are then zipped together further securing the animal head.

2 Claims, 4 Drawing Sheets

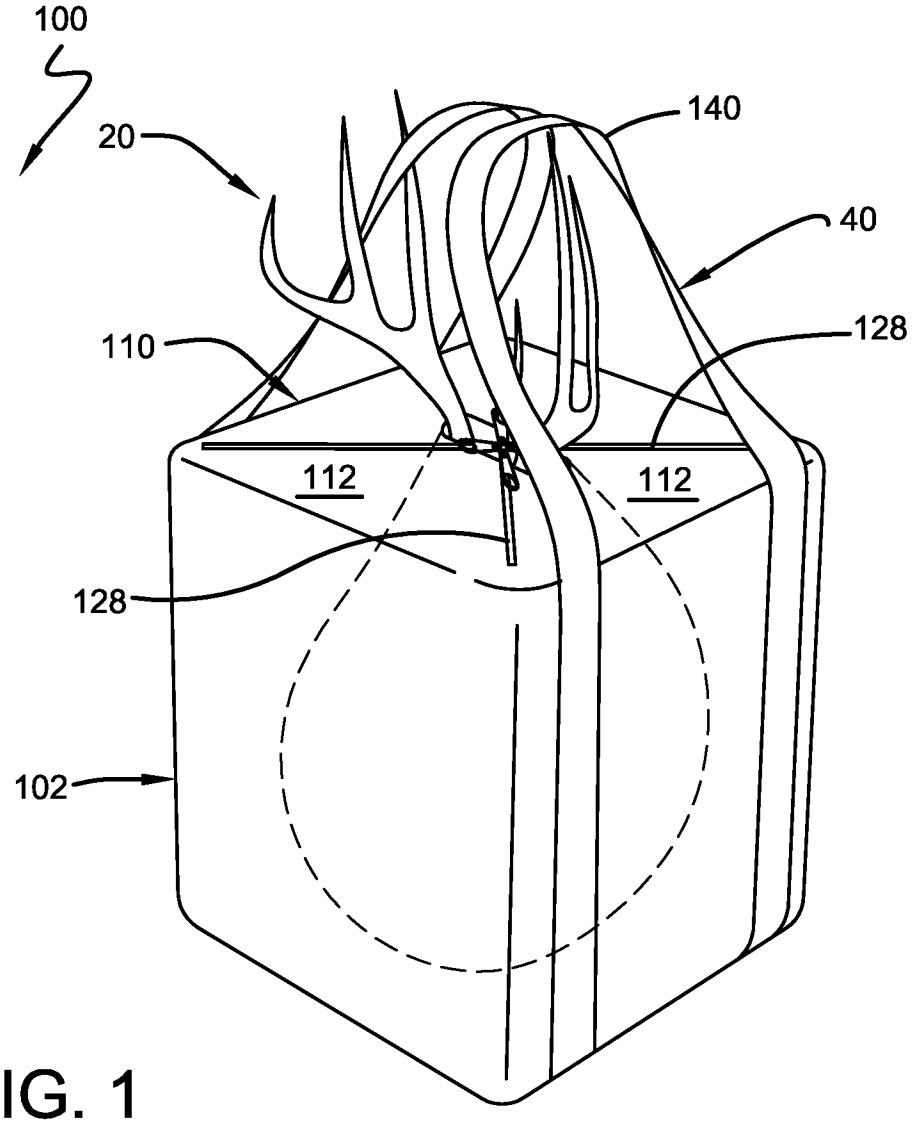
FIG. 1
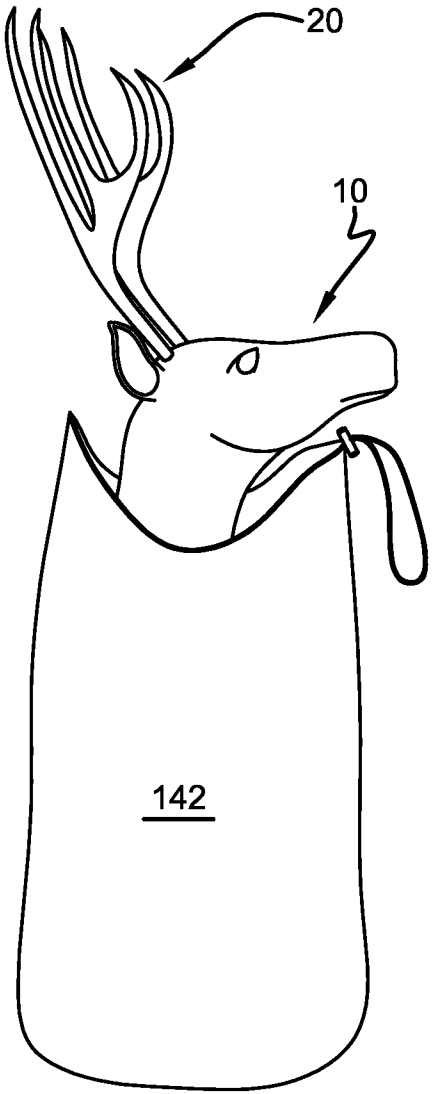

TROPHY CONTAINER APPARATUS

CROSS-REFERENCE

This application claims priority from Provisional Patent Application Ser. No. 61/828,292 filed May 29, 2013.

FIELD OF THE INVENTION

This invention pertains generally to an animal head trophy container, and more particularly to a collapsible container for protecting, storing, and transporting wild game animal heads with antlers for later taxidermy.

BACKGROUND

Hunters often hunt for sport in addition to the desire to harvest meat from wild game. Once an animal desirable as a trophy head such as a deer or elk is killed, it is difficult to preserve the head and antlers intact without damage long enough to transport the carcass to a taxidermist for preservation. If the head is left on the animal, it may easily become damaged in transit or begin to spoil due to exposure to the elements. Traditional devices for properly packaging freshly harvested animals can be bulky and complicated to utilize. They often require packaging of the entire animal which takes up significant transportation space.

Consequently, there exists a need for a device designed to provide for the safe transportation of a hunting trophy that prevents spoilage of the skin before the trophy may be preserved. The proposed invention provides a protective container that can safely transport the head and antlers or horns of freshly harvested wild game from the woods to a taxidermist without taking up excessive space during removal from the field and during transport. The invention is collapsible for easy transportation to the sight of the harvesting, fits in most vehicles, and protects the skin of the animal from the wind, rain, sun, and other natural elements so that the trophy may be properly prepared at a later time.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a collapsible container for storing and transporting the head of an animal with antlers or horns such as a deer, elk, moose, or the like. The collapsible container comprises a base component and at least one strap attached to the base component. The base component comprises a bottom, four sides, and a lid that define an interior cavity therein for placing the head of the animal. The lid comprises four flaps attached to the four sides and substantially encloses the interior cavity when the lid is in place. Additionally, the lid comprises four connecting elements for opening and closing the lid, and a centrally disposed opening for permitting passage of the antlers once the head of the animal is secured within the collapsible container.

Furthermore, in a preferred embodiment of the invention the collapsible container is approximately cubical in configuration. The four flaps are substantially triangular with a vertex of each triangle removed to create the central opening in the lid. The four connecting elements are four zippers oriented on a diagonal across the lid with each of the zippers extending into the central opening. The central opening is tubular or capsular in shape to permit easy passage of the antlers through the lid when the animal head in secured within the collapsible container. Additionally, the collapsible container further comprises a securing element for connecting two of the flaps. The securing element spans the central opening further securing the antlers.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

FIG. 1 illustrates a perspective view of a collapsible container storing an animal head in accordance with the disclosed architecture.

DETAILED DESCRIPTION

Figure 2A:
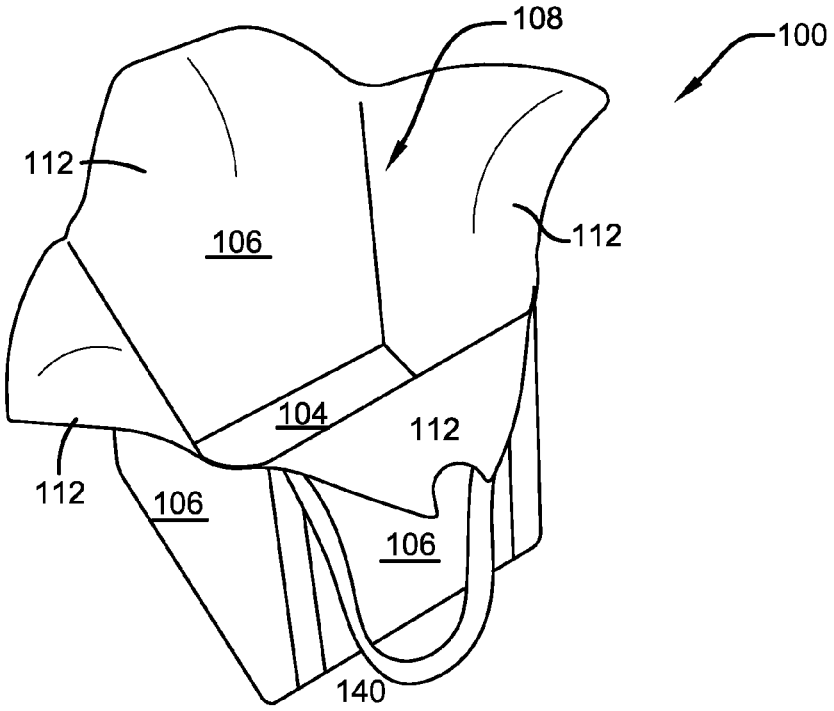
FIG. 2A illustrates a top view of the collapsible container without an animal head in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter. The invention relates generally to a portable container for temporarily preserving and transporting the head of a game animal with antlers once harvested.

Referring initially to the drawings, FIGS. 1-4 illustrate a collapsible container 100 for storing a head of a trophy animal. The collapsible container 100 allows a hunter to temporarily preserve an animal head 10 with an antler 20 along with a cape or shoulder skin. While the collapsible container 100 is typically for use in transporting trophy heads of antlered or horned animals such as deer and elk, it may also be used to completely encapsulated smaller game animals such as turkey, waterfowl, rabbits, and the like for transport.

As illustrated in FIG. 1, the collapsible container 100 comprises a base component 102 and at least one strap element 140 attached to the base component 102. The base component 102 comprises a bottom 104 and four sides 106 substantially defining an interior cavity 108 therein for retaining the animal head 10. The base component 102 is typically manufactured from layers of material to create an insulated water resistant barrier. In a preferred embodiment, the base component 102 materials may comprise a layer of foam rubber, or other insulating material sandwiched between an outer layer of water resistant canvas, duck cloth, plastic sheeting, or the like; and an inner water proof layer of vinyl, polyethylene, or similar plastic sheeting as is known to one of skill in the art. These materials are desirable as they are light weight and fold or roll up for storage when not in use. This permits the hunter to easily carry the collapsible container 100 while hunting to the location of harvested the animal.

The base component 102 is generally rectangular or cubical in configuration defining a corresponding rectangular or cubical interior cavity. The base component 102 may be between approximately 14 inches and 36 inches in length, width, and height. A rectangular embodiment of the collapsible container 100 would be desirable to completely contain smaller game without antlers such as a wild turkey; whereas a more cubical embodiment would better fit a deer head with antlers.

Figure 2B:
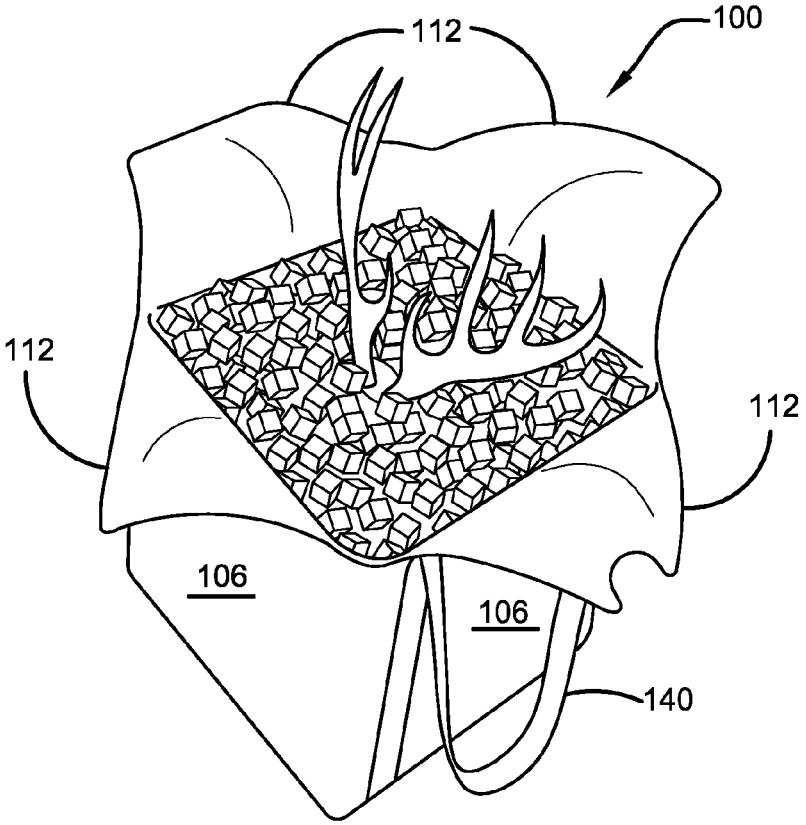
FIG. 2B illustrates a top view of the collapsible container with an animal head in accordance with the disclosed architecture.

As illustrated in FIGS. 2A and 2B, the base component 102 further comprises a lid 110 attached or affixed to and extending out from the four sides 106. When closed, the lid 110 substantially encapsulates the interior cavity 108. The lid 110 comprises four flaps 112, four connecting elements 128, and an opening 122. The four flaps 112 are approximately triangular in shape with a base of each triangular shape adjacent to each of the four sides 106. In a preferred embodiment, the lid 110 is approximately square in shape with the four flaps 112 each approximately isosceles triangles in shape. A pair of legs of each triangular flap 112 extends inward across the lid 110 essentially on a diagonal terminating in a vertex at a center of the lid 110. Each leg of each flap 112 is adjacent to a leg of the bordering flap 112 so that the four flaps 112 essentially form a square when the lid 110 is closed. In the embodiment where the lid 110 is essentially square shaped, each vertex would have an angle of approximately 90 degrees.

Figures 3A, 3B:
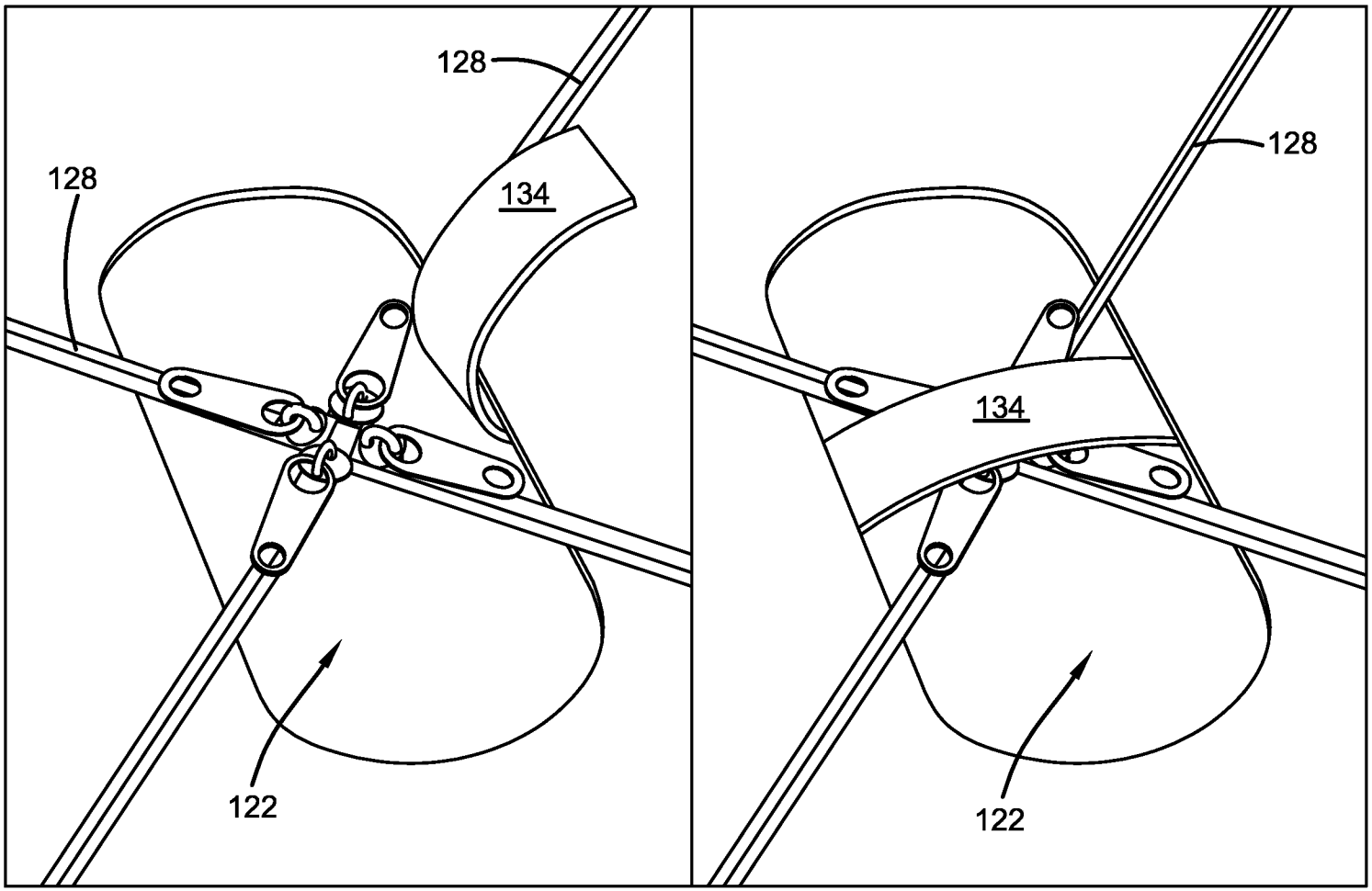
FIG. 3A illustrates a perspective view of a lid of the collapsible container in accordance with the disclosed architecture.
FIG. 3B illustrates a perspective view of the lid of the collapsible container in accordance with the disclosed architecture.

As illustrated in FIGS. 3A and 3B, the opening 122 is formed by removing a portion of the vertex of each flap 112 and is approximately centrally disposed in the lid 110. The opening 122 permits the antlers 20 to pass through the lid 110 when the animal head 10 is contained within the base component 102. The opening 122 is typically configured in a tubular, or a pill capsule shape. To create the opening 122, two opposite flaps 112 have a U-shape cut out of the vertex to form ends of the opening 122; and the other two opposite flaps 112 have the vertex cut off essentially parallel to the base of the flap 112 to form sides of the opening 122. This shape is desirable as it accommodates the anatomy of most antlered animals. However, the opening 110 may comprise any other shape that would permit the passage of the antlers 20, such as but not limited to an oval, a rectangle, a square, and the like.

The four connecting elements 128 removably connect the adjacent flaps 112 along the adjacent legs. In other words, the connecting elements 128 are essentially diagonally oriented across the lid 110 forming an X-configuration in a closed position when the flaps 112 are connected. The four connecting elements 128 are typically zippers long enough to extend approximately from each corner of the lid 110 to terminate in the center of the lid 110 spanning the opening 122. However, this is not meant as a limitation as the four connecting elements 128 may comprise hook and loop fasteners such as VELCRO®, snaps, buttons, and the like, or any other type of openable connector as is known to one of skill in the art. The diagonal orientation of the connecting elements 128 is desirable as it permits easy and complete opening of the lid 110. The four flaps 112 unzip to completely open the lid 110 and unenclosed the interior cavity 108 of the base component 102. This is desirable as a single zippered opening would require the hunter to keep the sides of a lid pried apart as the animal head 10 was inserted in the container.

Figure 4:
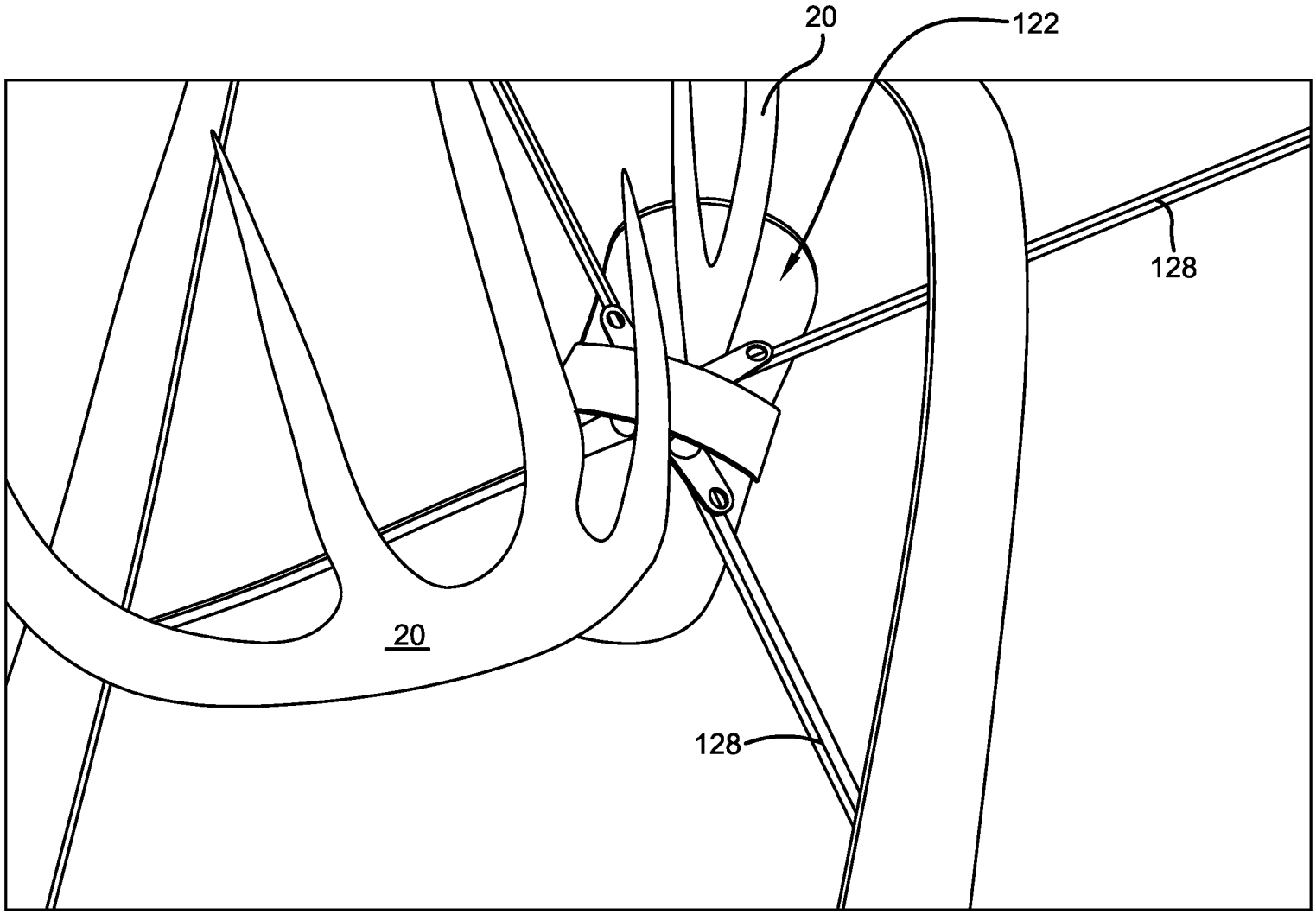
FIG. 4 illustrates a perspective view of antlers secured in an opening in the lid of the collapsible container in accordance with the disclosed architecture.

The base component 102 further comprises a securing element 134. The securing element 134 removably connects two of the opposing flaps 112 across the opening 122. The securing element 122 is typically a nylon, cloth, fabric strap, or the like that is permanently affixed, sewn, adhered, or the like to one flap 112, and removably attaches to the opposing flap 112 with hook and loop fasteners, buttons, snaps, or the like. When connected as illustrated in FIG. 4, the securing element 134 removes the strain from the connecting elements 128 further securing the lid 110 in place around the antlers 20.

In a preferred embodiment, the at least one strap element 140 is two straps attached to the sides 104 of the base component 102 for better balance when carrying the collapsible container 100. The collapsible container 100 may further comprise a removable inner bag 142 for further containing the animal head 10. The removable inner bag 142 is typically a plastic bag with or without a drawstring for containing any body fluids. To use the collapsible container 100, the lid 110 is unzipped and the flaps 112 are folded back exposing the interior cavity 108. The animal head 10 is optionally placed into the removable inner bag 142 which is then placed within the inner cavity 108 and may be packed in ice. The four flaps 112 are zipped up around the antlers 20 which protrude through the opening 122. The securing element 134 is connected across the opening 122, and the collapsible container 100 may be transported.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A collapsible container for transporting an antlered animal head comprising:

an insulated waterproof base component comprising:

a bottom and four sides that define a cubical interior cavity therein; and a lid affixed to the four sides to substantially enclose the cubical interior cavity, wherein the lid comprises four substantially isosceles triangular flaps wherein one substantially isosceles triangular flap is secured to each side, four connecting elements substantially diagonally disposed across the lid for attaching adjacent flaps to each other, and a pill capsule shaped opening centrally disposed in the lid; and a plurality of strap elements attached to the base component; and a securing element attachable to two of the four flaps for spanning the opening in the lid between the animal head antlers and connecting the two of the four flaps; and wherein the four connecting elements are zippers which extend into the pill capsule shaped opening; and wherein each substantially isosceles triangular flap has a vertex angle removed to create the pill shaped opening; and wherein each substantially isosceles triangular flap unzips to completely open the lid so that the base component may receive the antlered animal head; and wherein the pill capsule shaped opening permits passage of the animal head antlers.

2. The collapsible container of claim 1, further comprising a removable inner bag for separating the animal head from the base component.

* * * * *